US006554136B2

(12) United States Patent
Priebe

(10) Patent No.: US 6,554,136 B2
(45) Date of Patent: Apr. 29, 2003

(54) MEDICATION ORGANIZER

(75) Inventor: Robert N. Priebe, Bloomington, MN (US)

(73) Assignee: Apothecary Products, Inc., Burnsville, MN (US)

( * ) Notice: Subject to any disclaimer, the term of this patent is extended or adjusted under 35 U.S.C. 154(b) by 0 days.

(21) Appl. No.: 09/944,713

(22) Filed: Aug. 31, 2001

(65) Prior Publication Data

US 2003/0042168 A1 Mar. 6, 2003

(51) Int. Cl.[7] ..... B65D 83/04

(52) U.S. Cl. ..... 206/538; 206/539; 206/1.5; 116/308

(58) Field of Search ..... 206/538, 539, 206/534, 534.1, 1.5, 562; 116/308

(56) References Cited

U.S. PATENT DOCUMENTS

| | | | | | |
|---|---|---|---|---|---|
| 3,537,422 | A | | 11/1970 | Moe | |
| 3,618,559 | A | | 11/1971 | Moe | |
| 4,038,937 | A | | 8/1977 | Möe | |
| 4,062,445 | A | | 12/1977 | Möe | |
| 4,735,318 | A | * | 4/1988 | Keffeler | 206/532 |
| 4,872,559 | A | | 10/1989 | Schoon | |
| 5,174,451 | A | * | 12/1992 | Niven | 206/534 |
| 5,240,113 | A | * | 8/1993 | Gibilisco | 206/534 |
| 5,267,650 | A | * | 12/1993 | Gilbilisco | 206/534 |
| 5,330,055 | A | * | 7/1994 | Kendra et al. | 206/534.1 |
| 5,379,899 | A | | 1/1995 | Thurell | |
| 5,381,904 | A | | 1/1995 | Thurell | |
| 6,000,546 | A | | 12/1999 | Noble | |

OTHER PUBLICATIONS

"Apothecary Products, Inc.," "The Ultimate Pharmacy Buyer's Guide to Drug Specialties," www.apothecaryproducts.com, 7 pages, (Sep. 2001).

Declaration of Robert Priebe regarding public availability of samples, dated Jan. 21, 2002.

Ezy–Dose® Child–Resistant Mediset® sample, Apothecary Products, Inc., Minneapolis, MN 55337 publicly available prior to Aug. 31, 2001.

Ezy–Dose® Clear–Vue Dosage Organizer™ sample, Apothecary Products, Inc., Minneapolis, MN 55337, publicly available prior to Aug. 31, 2001.

Ezy–Dose® Practidose sample, publicly availabe prior to Aug. 31, 2001.

Medi–Organizer sample, Health Enterprises, Inc., North Attleboro, MA 02760, publicly available prior to Aug. 31, 2001.

Web page printouts for Ezy–Dose® Child–Resistant Mediset®, dated Nov. 28, 2001.

Web page printouts for Ezy–Dose® Clear–Vue Dosage Organizer™, dated Nov. 28, 2001.

Web page printouts for Ezy–Dose® Practidose, dated Nov. 28, 2001.

Web page printouts for SurgiChem Nomad® Monitored Dosage System, dated Nov. 28, 2001.

* cited by examiner

*Primary Examiner*—Mickey Yu
*Assistant Examiner*—Jila M Mohandesi
(74) *Attorney, Agent, or Firm*—Merchant & Gould P.C.

(57) ABSTRACT

A portable dispenser for medical preparations comprising a box. An insert having several compartments arranged in columns and rows is adapted to be inserted into the box. A side cover which closes an opening in the side of the box is removable to allow the insertion and removal of the insert through the opening. The top portion of the dispenser has a plurality of surface covers slidable in grooves so that the surface cover is extractable in one direction. A locking arrangement locks the surface covers in a position closing the compartments.

15 Claims, 15 Drawing Sheets

MEDICATION ORGANIZER

BACKGROUND OF THE INVENTION

Use of a small portable dispenser for storage and dispensing of medications or drugs such as pills, tablets or capsules can increase patient compliance. Portable dispensers can be used at home, as portable devices for carrying medication, in medical facilities including hospitals or clinics and in facilities catering for those needing medical management such as group homes.

SUMMARY OF THE INVENTION

The invention provides a portable, small medicine dispenser for storage and dispensing of medicines that includes locking arrangement. The portable dispenser includes a box and an insert having several compartments which is adapted to be inserted into the box. The dispenser also includes a removable side cover that is configured to close an opening in the side of the box. The insert can be inserted and removed through the side opening. The top of the dispenser includes a plurality of apertures and removable surface covers. The surface covers are slidable in grooves in the apertures. A locking arrangement locks the surface covers in a position closing the apertures.

DETAILED DESCRIPTION OF THE PREFERRED EMBODIMENT

One embodiment of the invention will now be described in more detail with reference to the accompanying drawings.

Figure 1:
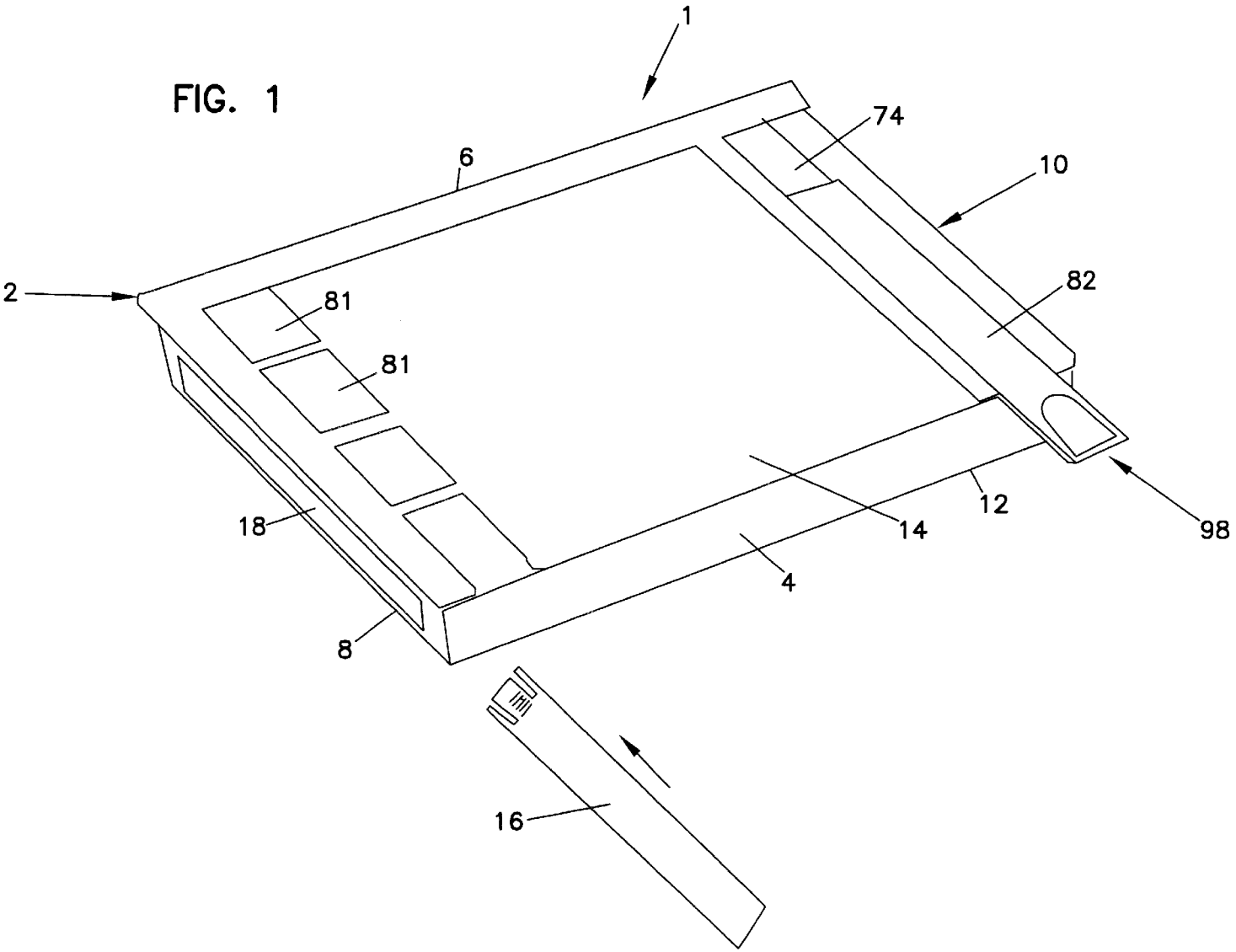
FIG. 1 is an exploded perspective view of the dispenser according to the invention.
Figure 4:
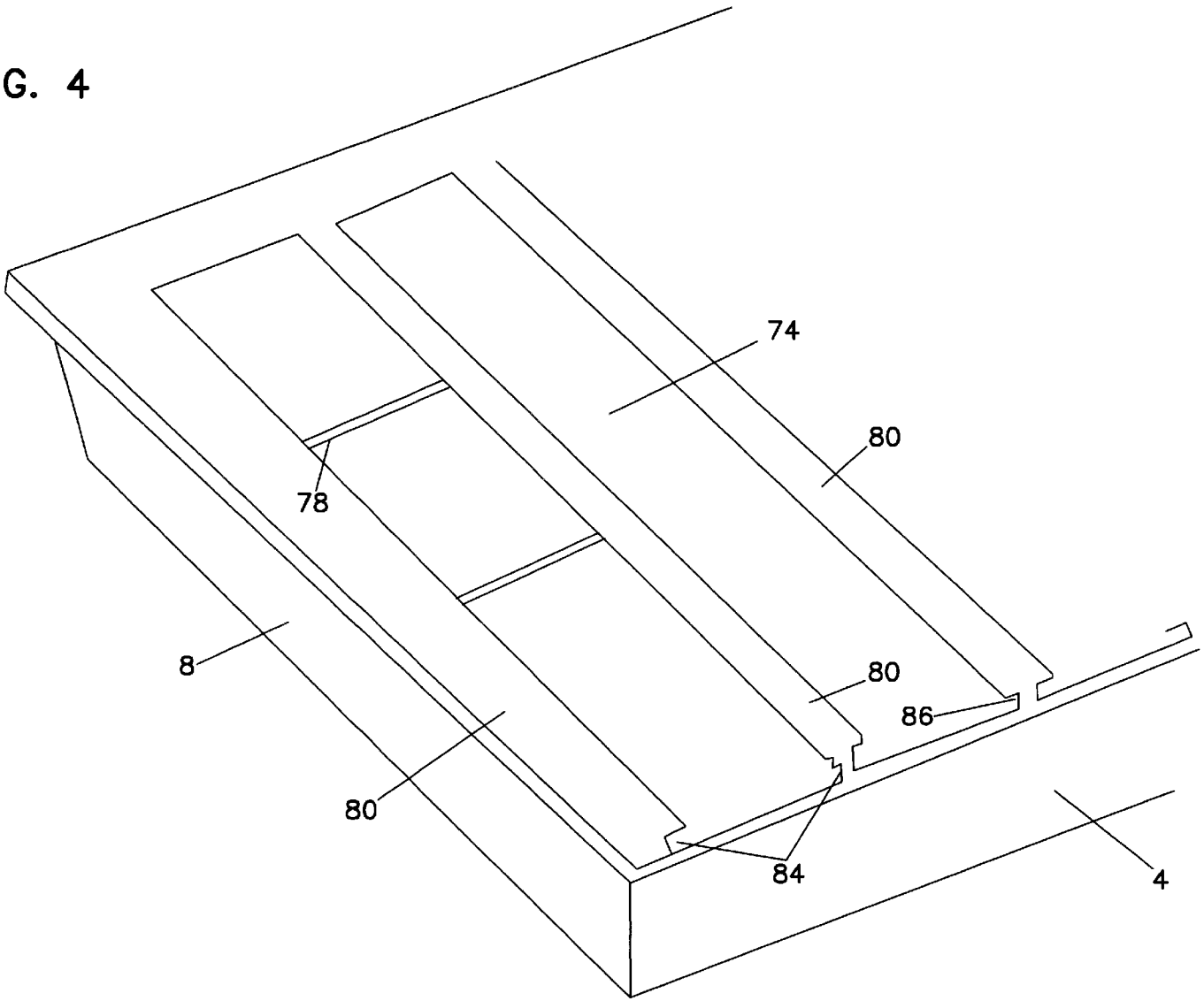
FIG. 4 is an enlarged partial view of FIG. 1.

A dispenser 1 according to the invention is shown in FIG. 1. The dispenser includes a box 2 having a front longitudinal side 4, a rear longitudinal side 6, a first transverse side 8 and a second transverse side 10, a bottom surface 12 and a top surface 14. The box can be rectangular or square. A plurality of apertures 74 are formed in the top surface 14. One or more elongate surface covers 82 are configured to slideably engage grooves 84 that extend along the inner surface 86 of each aperture 74 from the front longitudinal side 4 towards the rear longitudinal side 6. (See FIG. 4). A removable side cover 16 is configured to close an opening 18 in one of the transverse sides of the box 2. The removable side cover 16 permits insertion and removal of the insert 150. The dispenser 1 also includes a locking arrangement 115 for locking one or more of the surface covers 82 in a closed position and for unlocking one or more of the surface covers 82.

Figure 10:
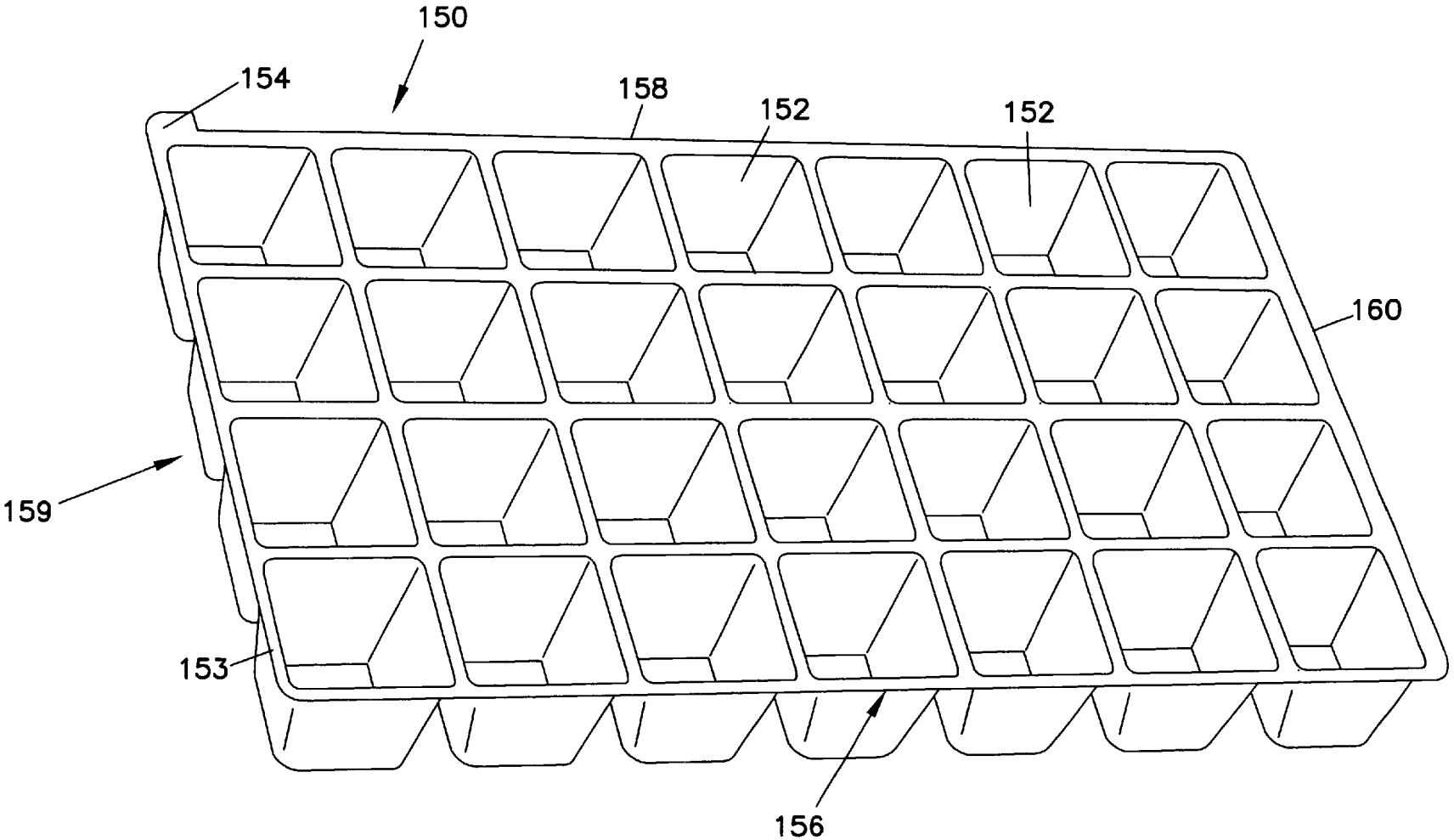
FIG. 10 is a perspective view of the insert.

An insert 150 having a plurality of compartments 152 is configured to fit inside the box 2. (See FIG. 10) The compartments 152 can be arranged in any suitable pattern. In the illustrated embodiment, the compartments are arranged in columnar rows. Each row of compartments 152 is positioned under a corresponding aperture 74 in the top surface 14. The compartments 152 are sized to accommodate various medical preparations such as tablets, capsules or pills.

1. Side Cover

Figure 2:
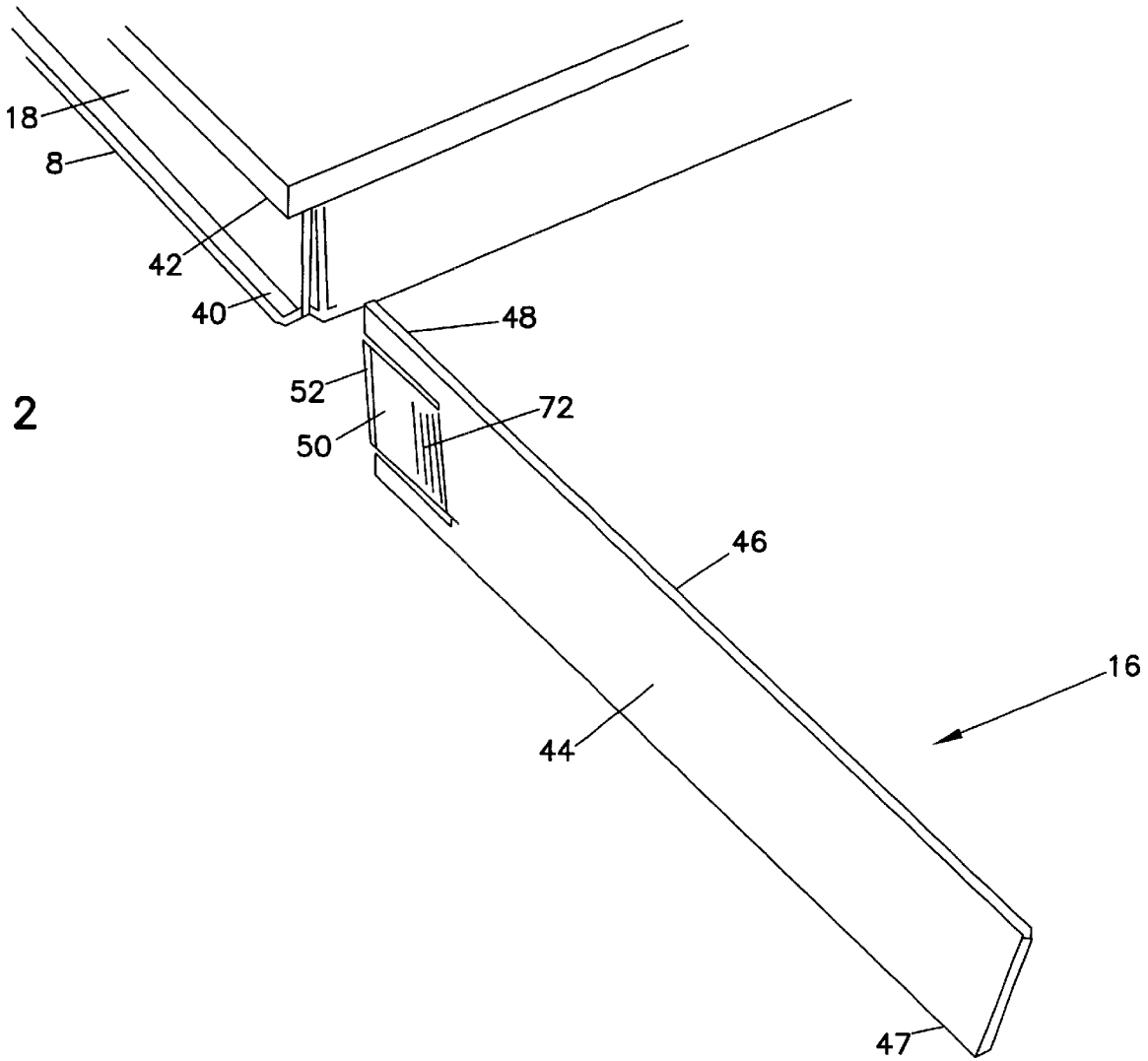
FIG. 2 is an enlarged partial view of FIG. 1.

According to one embodiment of the invention, the first transverse side 8 of the box 2 includes an opening 18. A removable side cover 16 is configured to close the side opening 18. (See FIGS. 1, 2) Generally, the side cover 16 has an outer surface 44 and an inner surface 46, a front end 47 and a rear end 48. The rear end 48 is configured to rest near the rear longitudinal side 6 of the box 2 when the side opening 18 is closed. The side cover 16 slideably engages a groove 40 that extends along the bottom surface of the opening 18, and a corresponding groove 42 that extends along the top surface of the opening 18.

Figure 3:
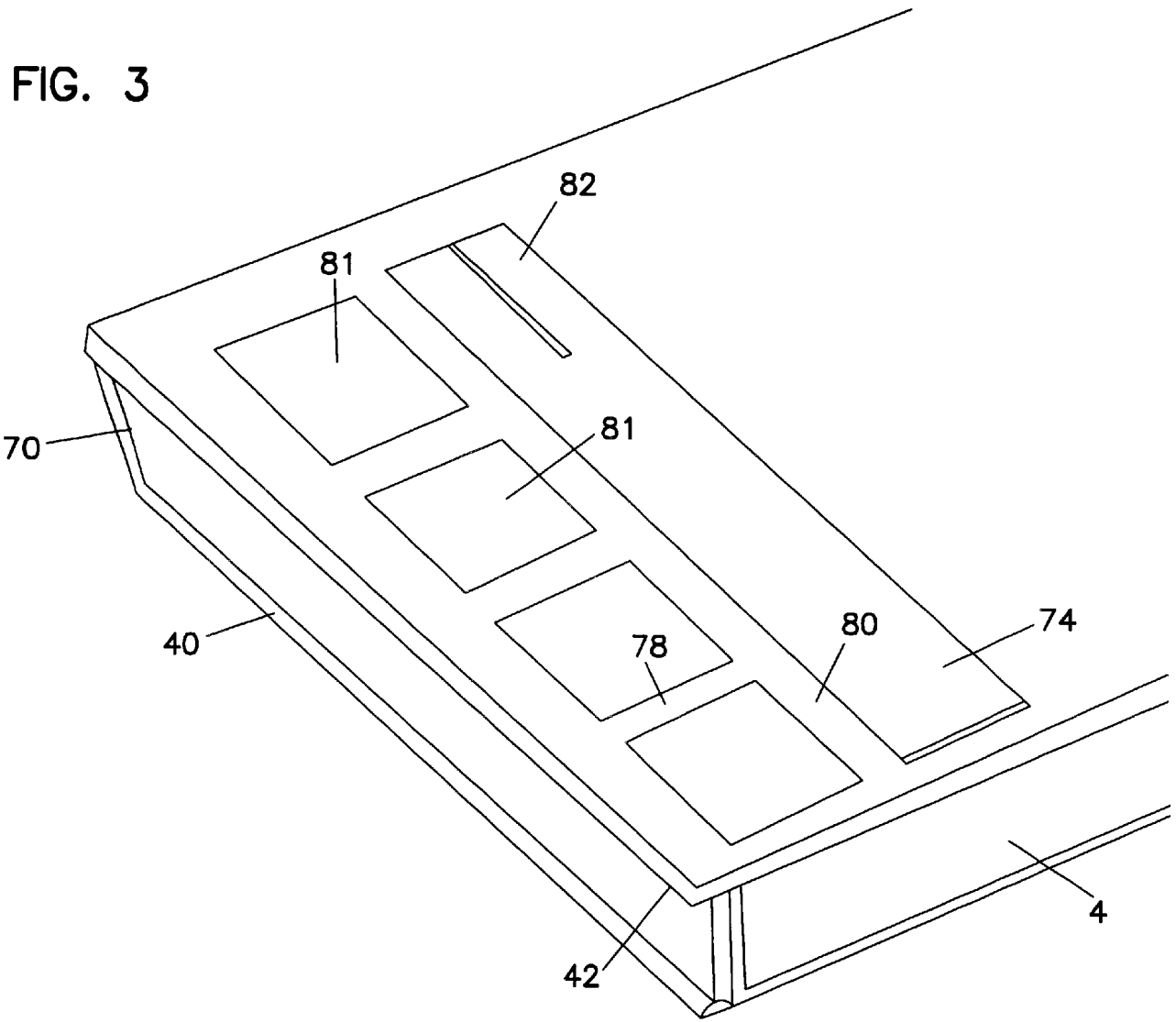
FIG. 3 is an enlarged partial view of FIG. 1.

The rear end 48 includes at least one flexible tab 50 having a flange 52 on the outer surface 44 for releasably engaging an inside edge 88 of a projection 70 that extends from the rear longitudinal side 6 of the box 2. According to the invention, the flexible tab 50 can be pressed inward to disengage the flange 52 from the inside edge 88 of the projection 70, such that the side cover 16 can be removed. In one embodiment, the flexible tab 50 includes a textured outer surface 72 to provide improved frictional engagement. (See FIGS. 2 and 3). The textured surface can be serrated, ridged, knurled, or have any other texture that provides a improved frictional engagement.

2. Top Surface

The top surface 14 of the box 2 includes one or more, typically a plurality, of apertures 74. More typically, the apertures 74 are elongate and extend from a location near the front longitudinal side 4 towards the rear longitudinal side 6 of the dispenser box 2. (See FIGS. 2 and 3). In one embodiment, the box 2 includes a plurality of elongate apertures 74 separated by one or more longitudinal struts 80 that extend from a position near the front longitudinal side 4 towards the rear longitudinal side 6 respectively. If desired, one or more elongate apertures 74 may also include one or more transverse struts 78 oriented generally perpendicular to the longitudinal struts 80. The transverse struts 78 define minor apertures 81.

One or more removable surface covers 82 can be configured to cover one or more apertures 74. According to the invention, the surface covers 82 slideably engage the grooves 84 within the inner surface 86 of the longitudinal struts 80. The surface covers 82 are generally removable in a direction transverse to the longitudinal sides 4,6 of the box 2. Typically, the surface cover 82 has a shape that corresponds to the shape of the aperture 74 that it is designed to cover. Thus, the surface cover 82 may be elongate to cover an elongate aperture 74. If desired, the surface cover 82 can be constructed from a transparent material such that the contents of the compartments 150 can be visualized, even when the cover 82 is in a closed position. (See FIG. 4) If one or more apertures 74 include one or more transverse struts 78, the elongate surface cover 82 can be configured to pass above or below the struts 78. If desired, one or more surface covers 82 can be slidable into various positions including a fully closed position, a fully locked position and a fully open position, and incremental positions therebetween.

3. Insert

According to one embodiment, the dispenser 1 also includes an insert 150 configured to be housed within the box 2. (See FIG. 10) The insert 150 includes one or more compartments 152, typically the compartments are upwardly open and configured to align with one or more apertures 74. The compartments 152 can be arranged in rows and columns, if desired. In particular, the compartments 152 can be arranged in rows and columns that corresponding to minor apertures 81 in the top surface 14 of the box 2. The insert 150 is removable from the dispenser box 2 via the opening 18 in the first transverse side 8.

In one embodiment of the invention, the insert 150 may be filled with medical preparations such as tablets or pills in accordance with the prescribed medical treatment each compartment 152 corresponding to a certain time of the day, and each row 153 of compartments corresponding to one day of the week.

The insert 150 has a front longitudinal side 156 and a rear longitudinal side 158, a first transverse side 159 and a second transverse side 160. (See FIG. 10)

Figure 15:
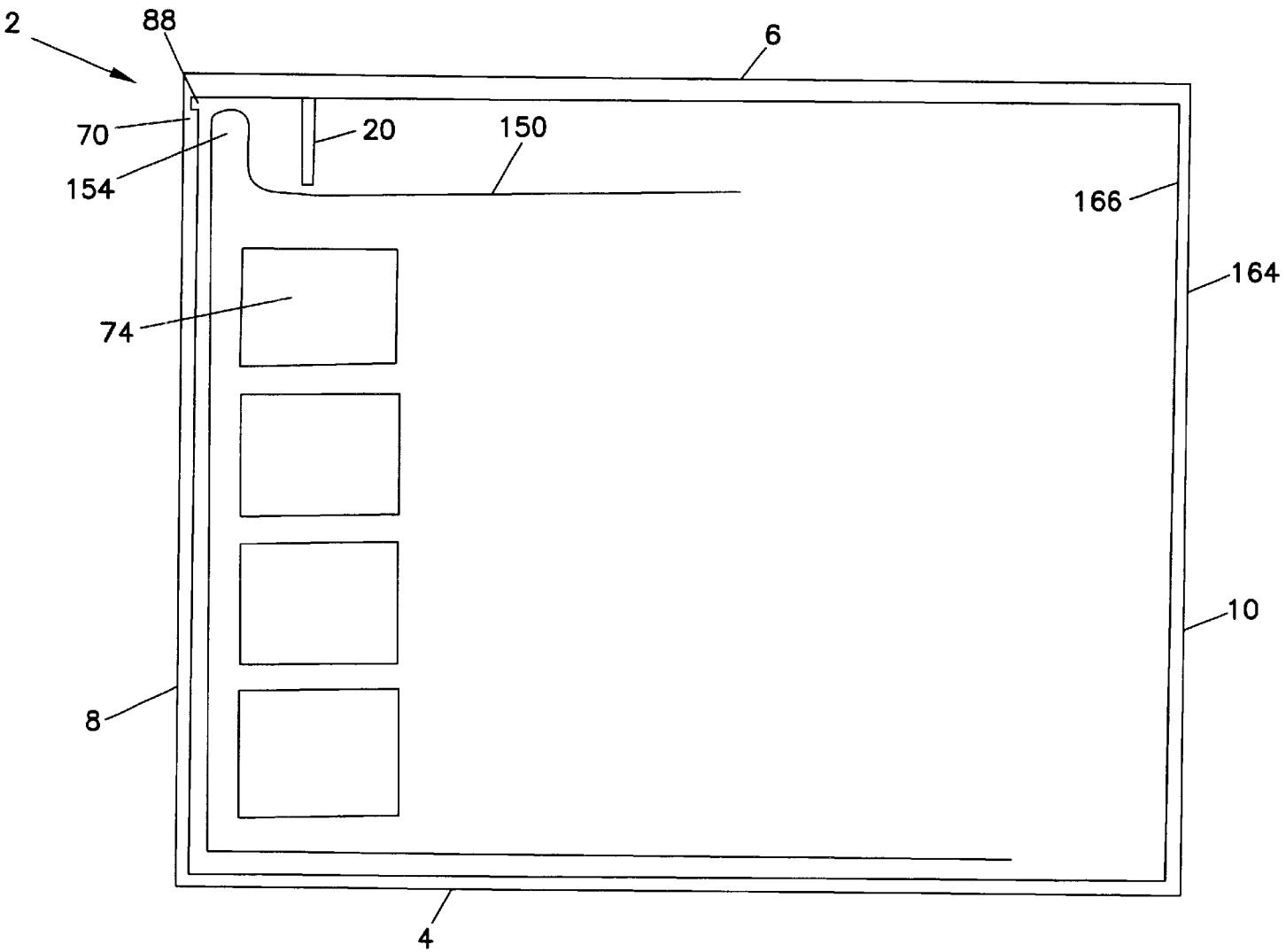
FIG. 15 is a partial view of the insert in the dispenser box.

It may be desirable in some instances to have an insert 150 that is insertable in the box 2 only in one orientation. In one embodiment, the insert 150 is pushed into the rectangular dispenser box 2 through the opening 18 in the first transverse side 8. (See FIGS. 1, 10) There is a projection 154 on the rear longitudinal side 158 of the insert 150 adjacent to the first transverse side 159 of the insert 150. (See FIG. 10) The insert 150 is pushed into the box 2 through the opening 18 in the first transverse side 8. Because of the differently dimensioned edges 156, 159 of the insert 150 and the presence of the projection 154 on the rear longitudinal side 158 it is impossible to insert it in the wrong way. If inserted in the wrong way, the projection 154 would not pass beyond the rib 20 formed on the inner surface of the rear longitudinal side 6. (See FIG. 15)

The compartments 152 are configured to accommodate medical preparations. In one embodiment, the compartments 152 are configured to accommodate medical preparations that are administered several times a day seven days a week. In one embodiment of the invention, the compartments of the insert are arranged in seven rows and four columns (See FIG. 10) to store preparations for administration on four different occasions a day for seven days.

4. Locking Arrangement

According to the invention, the dispenser 1 includes a locking arrangement 115 configured to secured the surface covers in a locked position. Generally, the locking arrangement 115 involves an interaction between one or more surface covers 82 and an elongate locking rod 120.

i. The Surface Cover

Figure 5:
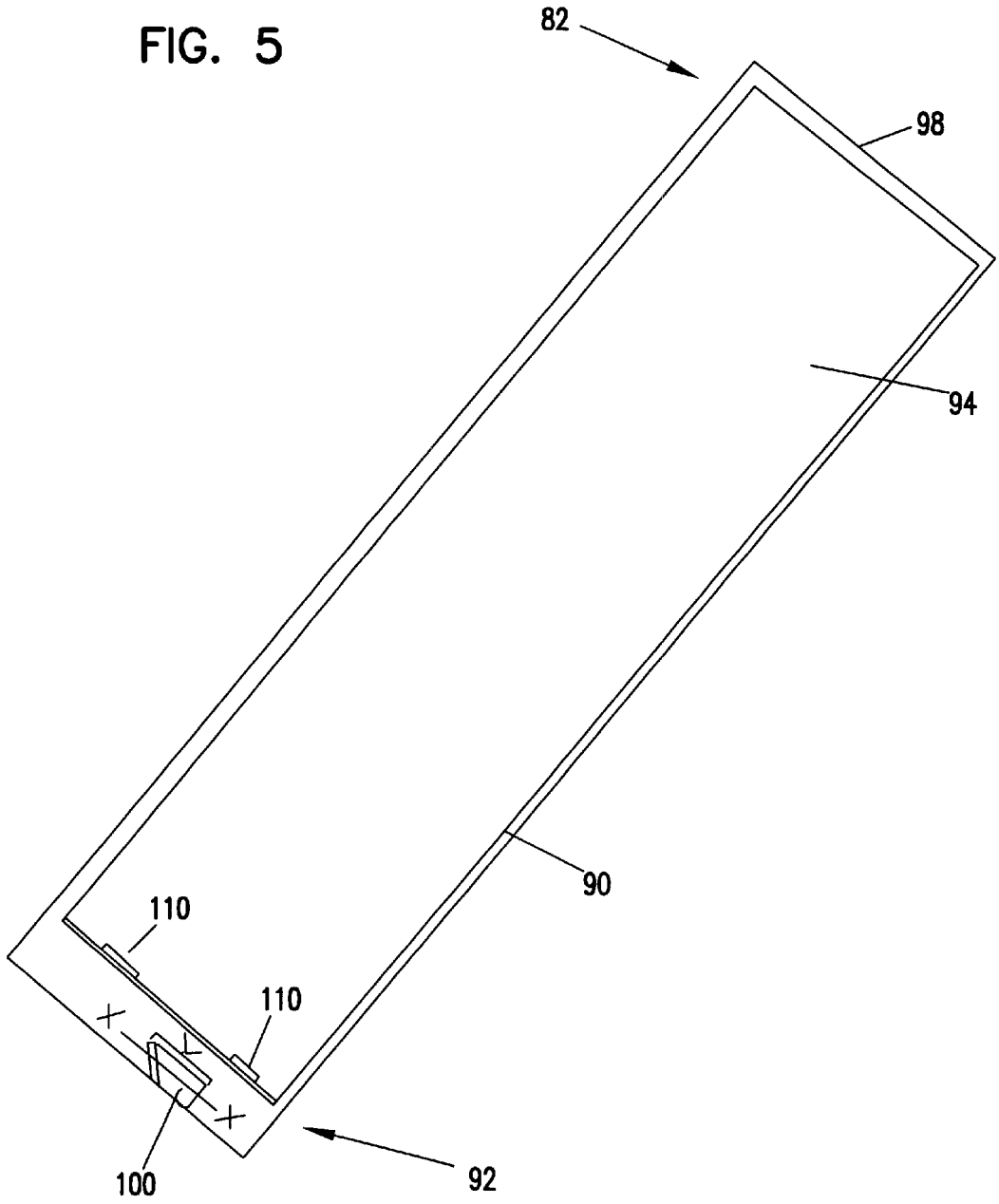
FIG. 5 is a bottom view of a surface cover according to the invention.
Figure 6:
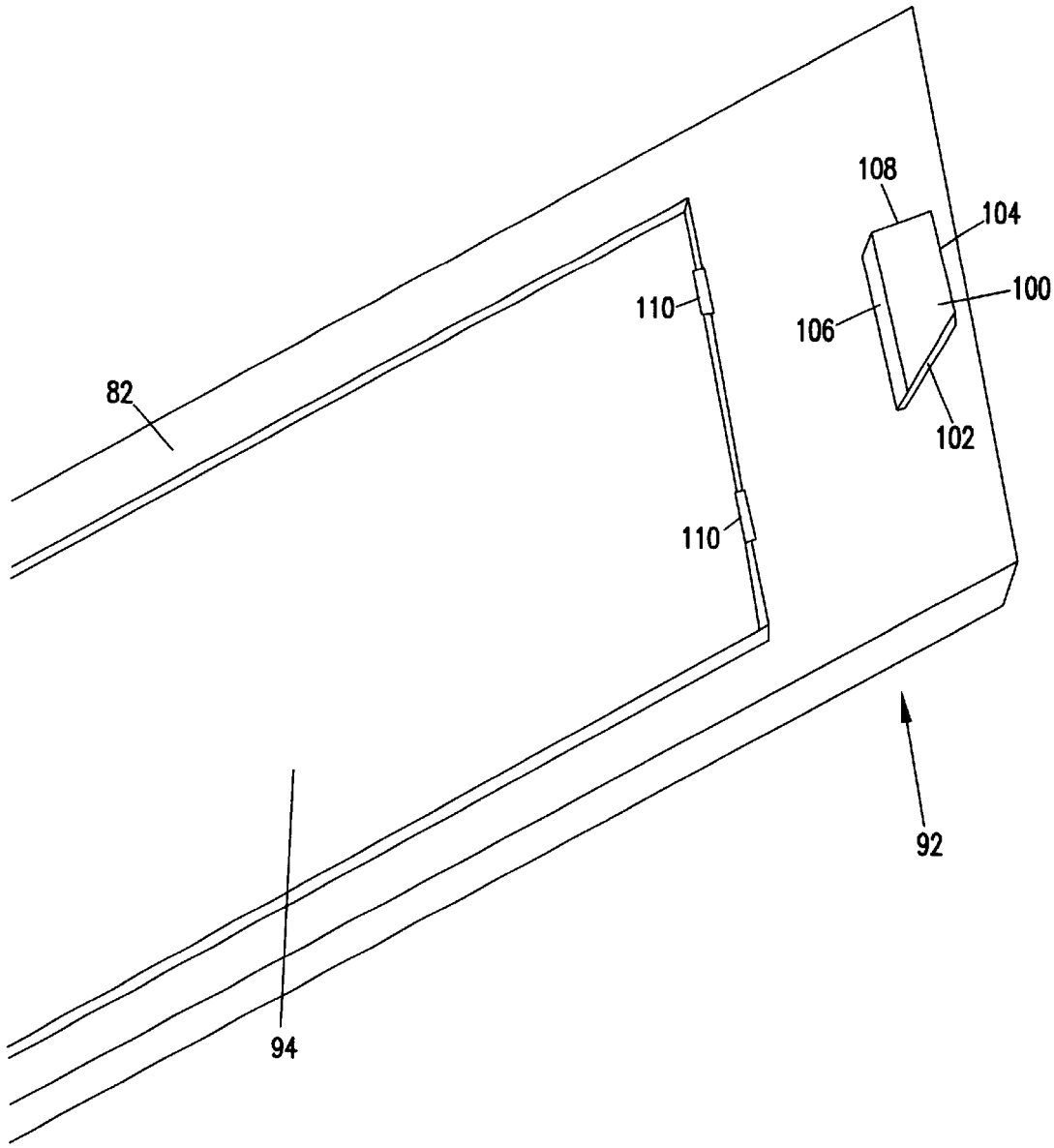
FIG. 6 is an enlarged partial view of the bottom of a surface cover of FIG. 5.

The surface covers 82 each have a first end 92 adjacent the rear longitudinal side 6 of the box 2, a second end 98 adjacent the front longitudinal side 4 of the box 2, a first side surface 93 configured to engage a groove of the longitudinal strut, a second side surface 99 configured to engage a groove of the longitudinal strut, an internal surface 94 and an external surface 96. (See FIGS. 5 and 6).

According to one embodiment, a rib 100 is located proximal the first end 92 of the surface cover 82, on the internal surface 94. The rib 100 has a length L thai extends from a position proximal the first side of the surface cover 93 towards a position proximal the second side of the surface cover 99. In one embodiment, the length L of the rib 100 is less than the distance between the first side surface 93 to the second side surface 99 of the surface cover 82.

The rib 100 includes a longitudinal axis X—X that is generally parallel to the longitudinal sides 4, 6 of the box 2. The rib 100 includes a front surface 106 (that faces the front longitudinal side 4 of the box 2) and a rear surface 104 (that faces the rear longitudinal side 6) of the box 2), and first side 102 and second side 108 surfaces.

According to the invention, the first side surface 102 is angled with respect to the longitudinal axis X—X of the rib such that the front surface 106 is longer than the rear surface 104. Generally, the angle results in the rib 100 having a rear surface 104 that is shorter than the front surface 106.

Figure 9:
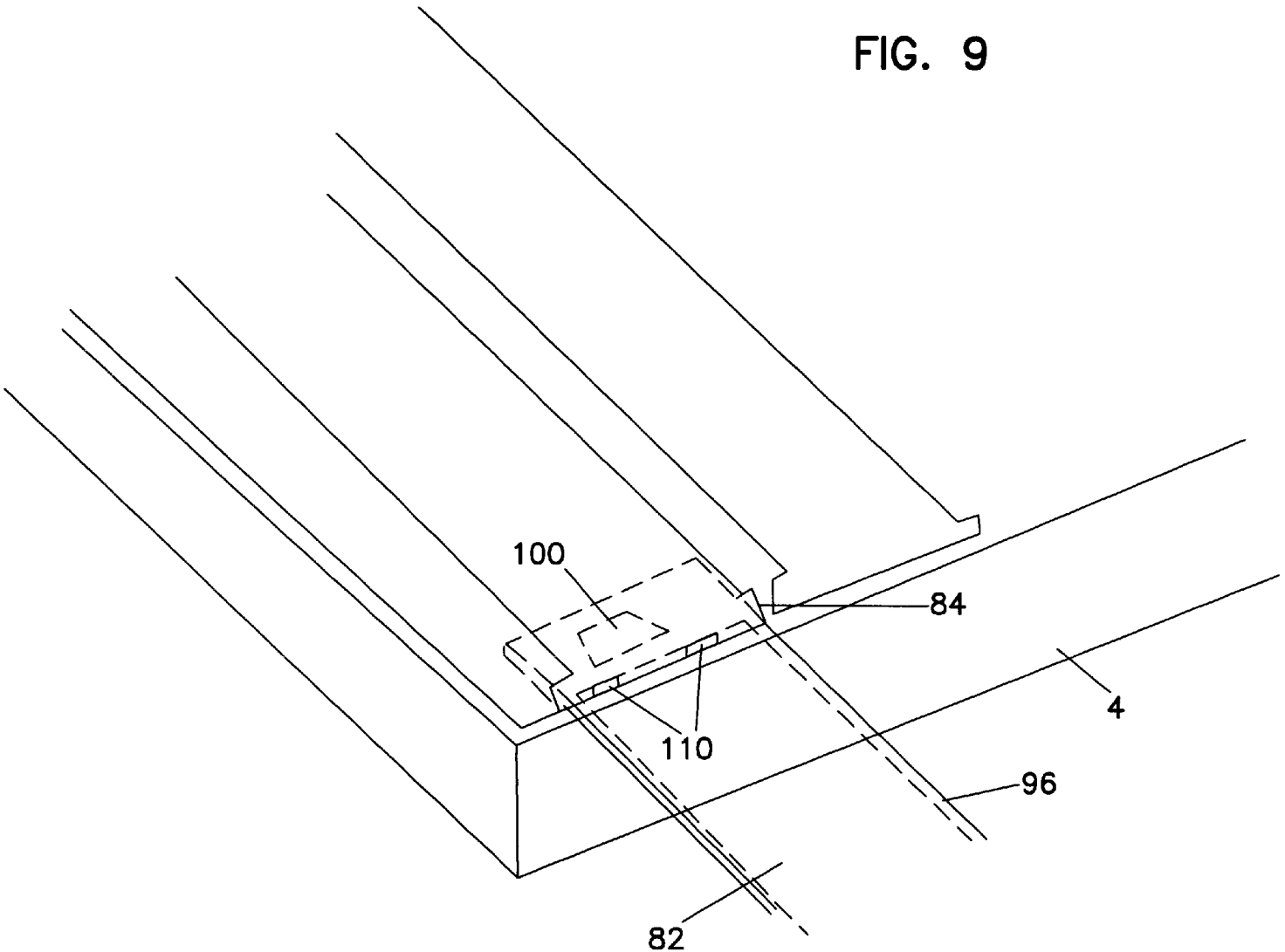
FIG. 9 is a partial view of the surface cover extended to interact with the front longitudinal side.

Additionally, the surface cover 82 may include one or more protrusions 110 projecting from the internal surface 94 of the surface cover 82. These protrusions 110 are disposed between the front surface of the rib 106 and the second end 98 of the surface cover 82. The protrusions 110 are configured to engage the front longitudinal side 4 of the rectangular dispenser box 2 to hinder complete removal of the surface cover 82 when the surface cover 82 is in a filly open position. (See FIG. 9).

Figure 12:
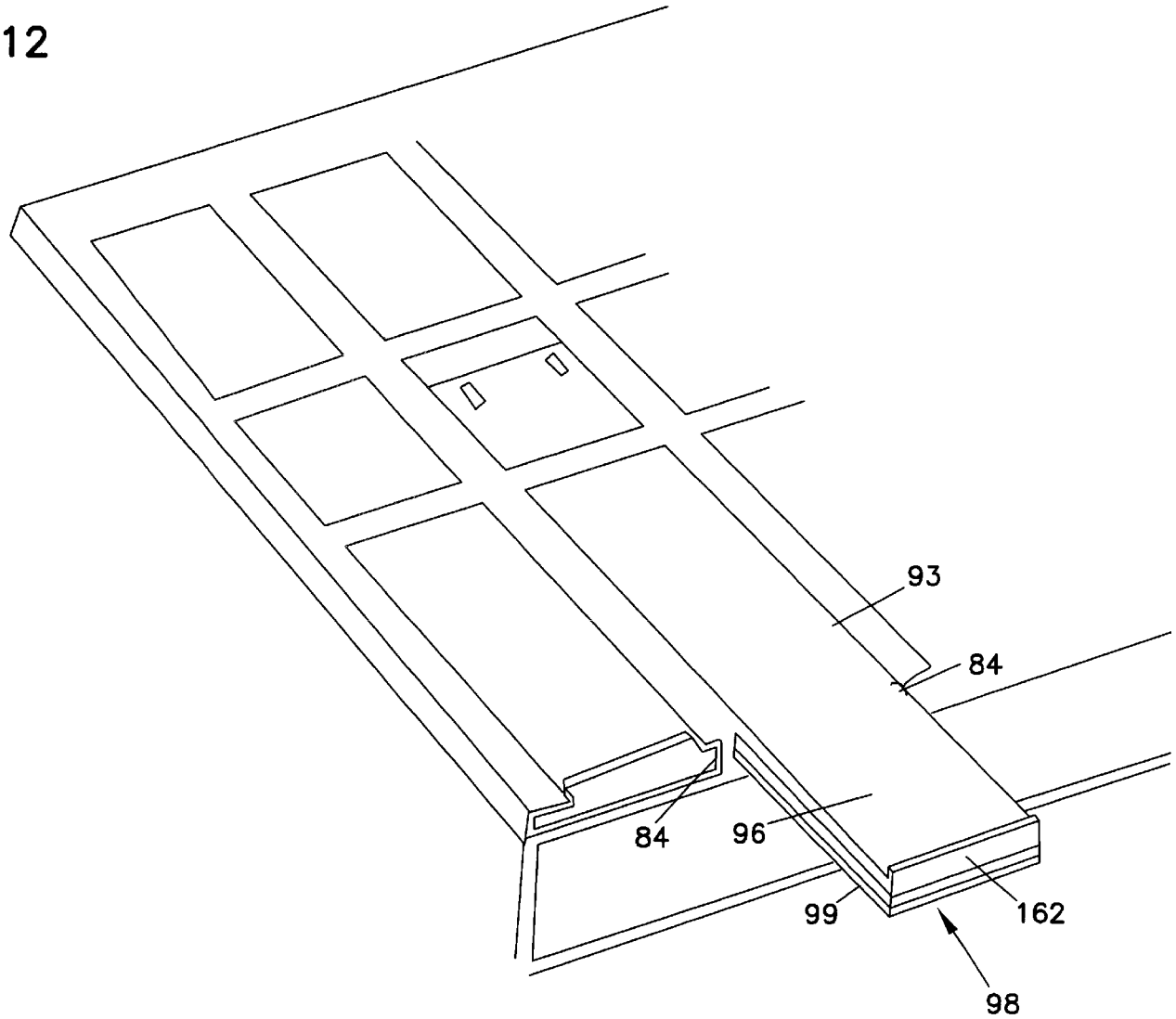
FIG. 12 is a perspective view of the external surface of the surface cover.

If desired, the surface cover 82 can include a wall 162 projecting from the external surface 96 of the surface cover 82 proximate the second end 98. The wall 162 provides a finger grip to facilitate removal of the surface cover 82. Generally, the wall 162 extends from a location proximate the first side surface 93 to a location proximate the second side surface 99 of the surface cover 82. (See FIG. 12) If desired, the wall 162 can extend from the first side surface 93 to the second side surface 99 of the surface cover 82.

ii. The Elongate Rod

Figure 7:
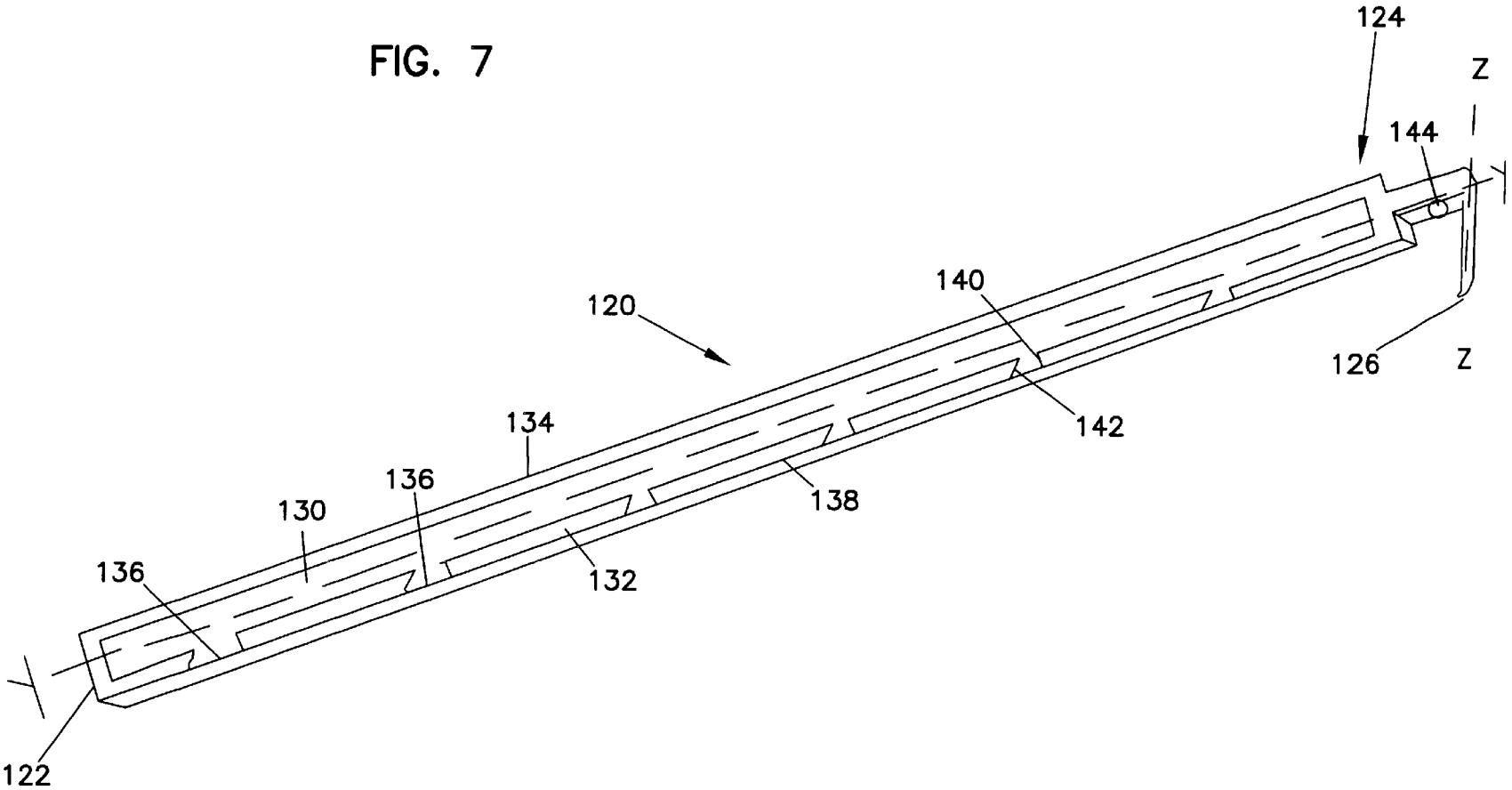
FIG. 7 is a perspective view of the locking arrangement according to the invention.
Figure 8:
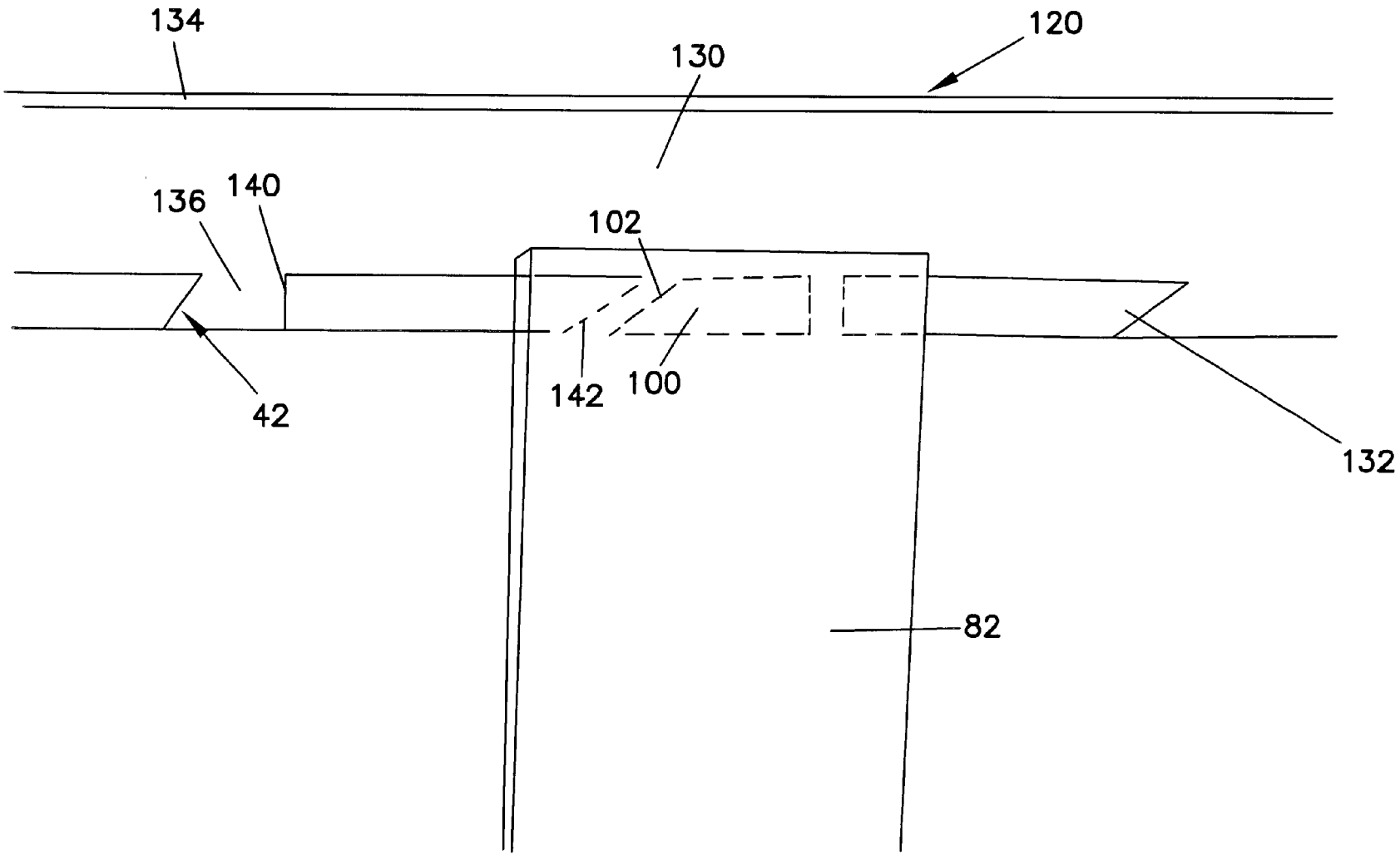
FIG. 8 is an enlarged partial view of the locking arrangement and the surface cover in the open position.
Figure 13:
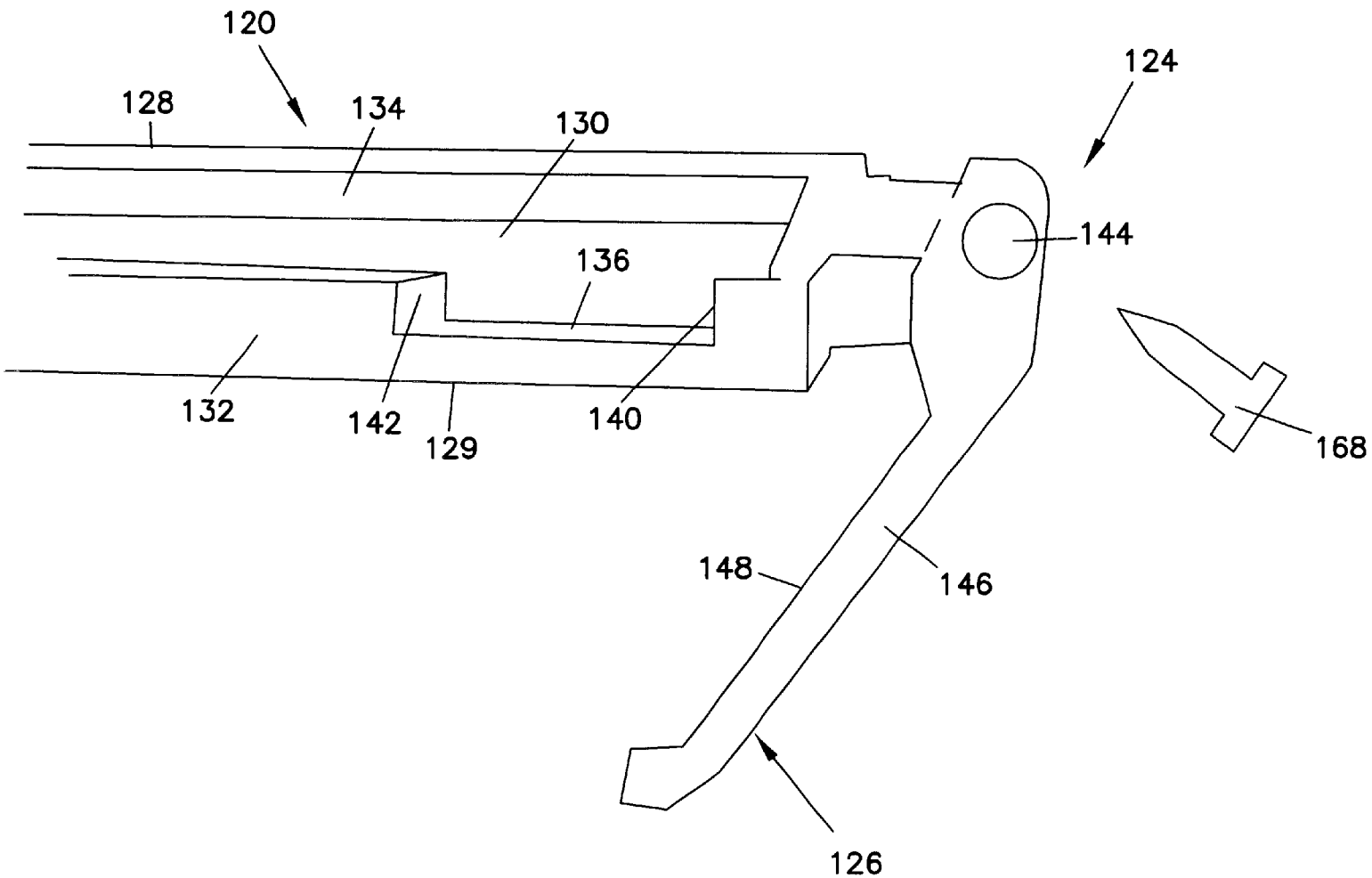
FIG. 13 is a perspective view of the actuating tab of the locking arrangement.

The locking arrangement 115 also includes an elongate rod 120 configured to slideably engage the rectangular dispenser box 2. The elongate rod 120 has a locked and unlocked position and generally includes a leading end 122 and a trailing end 124. (See FIG. 7); and an upper surface 128 and a lower surface 129 (See FIG. 13). According to the invention, the upper surface includes a channel 130 that extends from a position proximate the leading end 122 to a position proximate the trailing end 124 of the elongate rod 120. The channel 130 includes a first wall 132 and a second wall 134. The first wall 132 includes one or more recesses 136 configured to align with the ribs 100 of the surface cover 82 when the elongate rod 120 is in an unlocked position. (See FIG. 8).

The recesses 136 each include a leading side surface 142 and a trailing side surface 140. (See FIGS. 7 and 13) The leading side surface 142 of the recess 136 is angled with respect to the longitudinal axis of the leading side surface 142. (See FIGS. 7 and 13).

Figure 14:
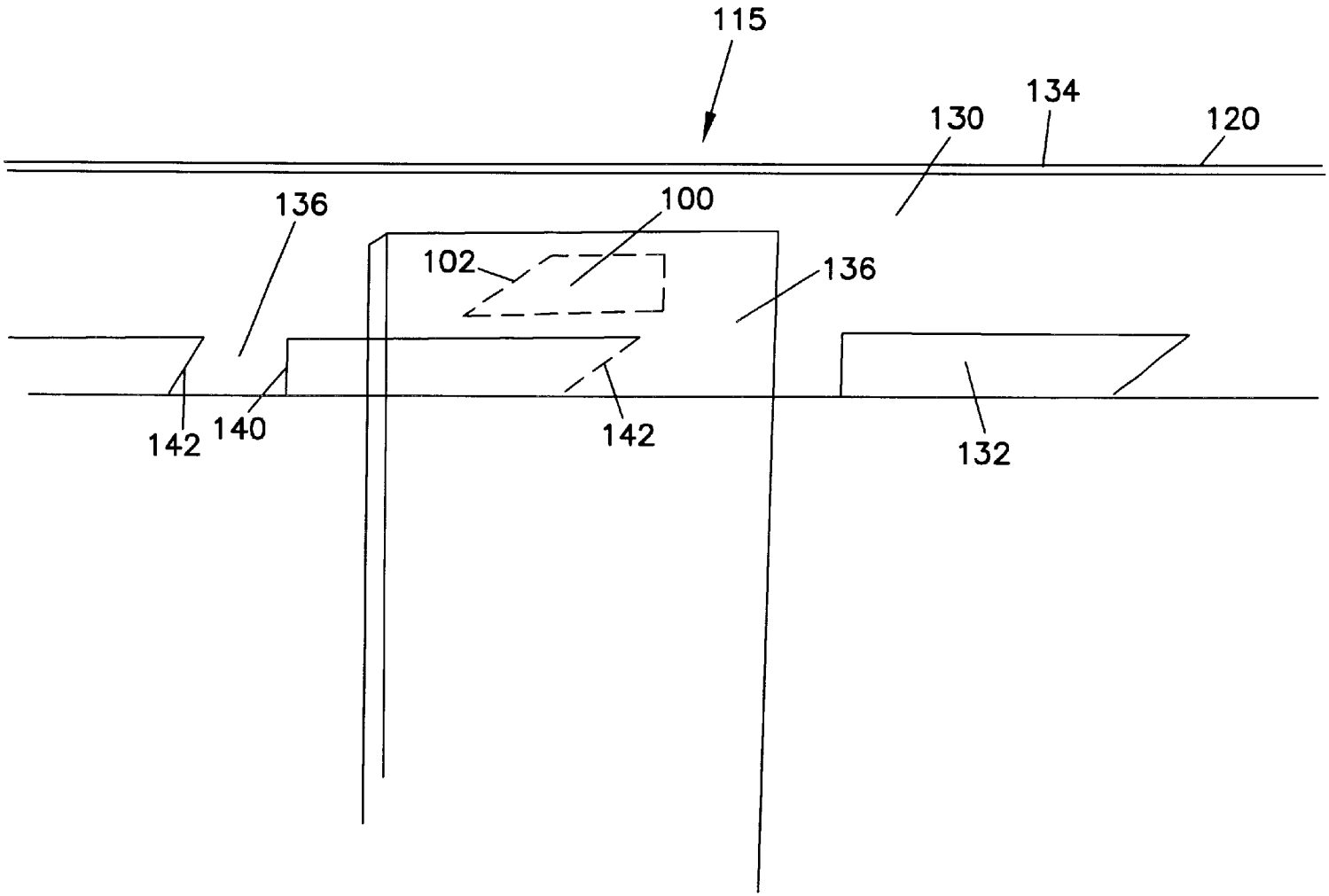
FIG. 14 is an enlarged partial view of the locking arrangement and the surface cover in the locked position.

Generally, the angle of the leading side surface 142 is complementary to the angle of the first surface 102 of the rib 100 of the internal surface 94 of the surface cover 82. (See FIG. 8). The angled first side surface 102 of the rib 100 slidingly engages the angled leading side surface 142 of the recess 136 of the elongate rod 120 when the rod is in the locked position. (See FIG. 14).

In one embodiment of the invention, the elongate rod 120 is made of a resilient plastic, so that when the pressure exerted on the actuating tab 126 is released, the engagement between the ribs 100 of the untouched surface covers 82 and the first wall 132 is automatically reinstated.

If desired, the rectangular dispenser box 2 can be manufactured from a resilient plastic that is transparent to allow a user to view the contents of the dispenser 1.

iii. Actuating Tab

Figure 11:
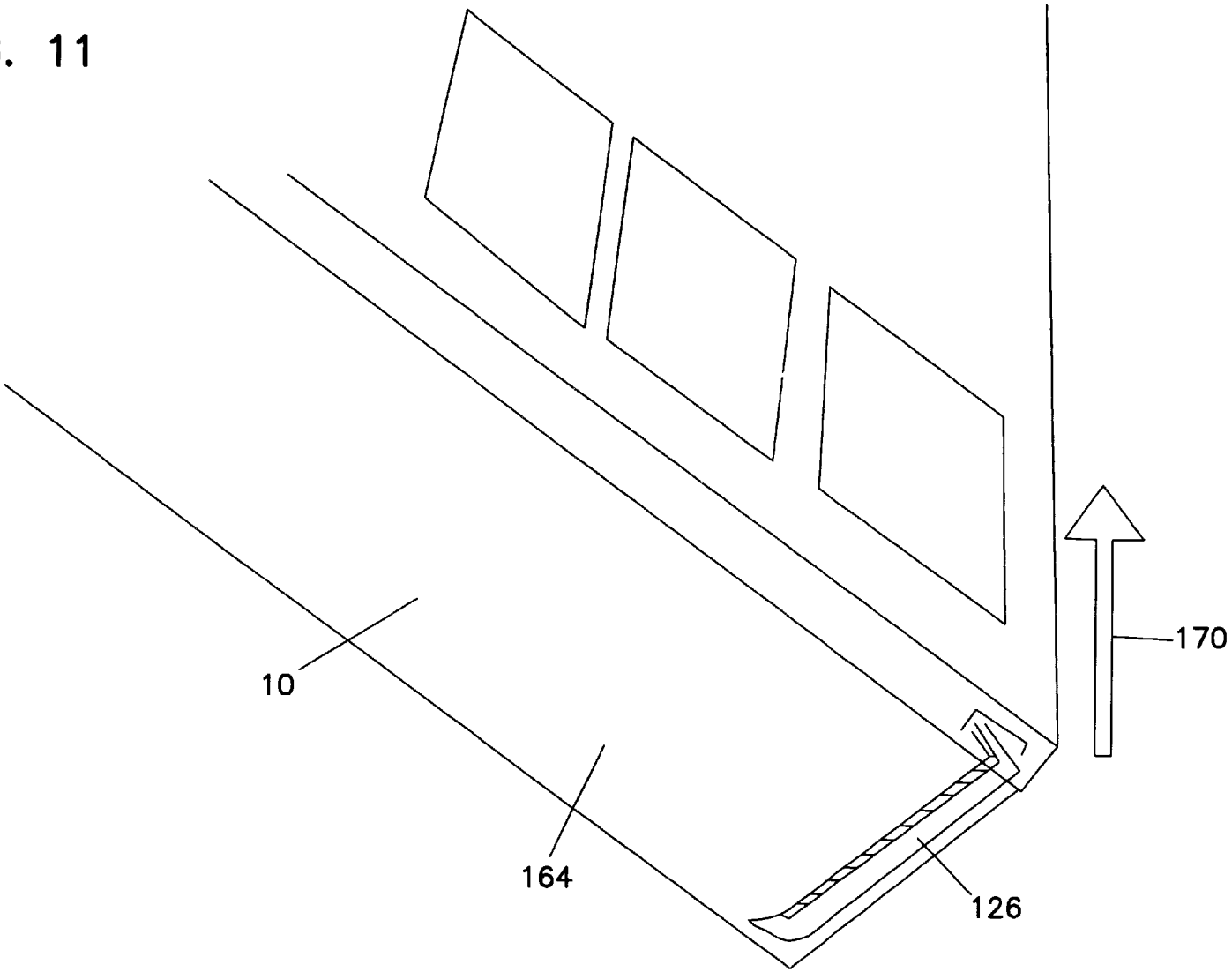
FIG. 11 is a perspective view of the actuating tab of the locking arrangement.

In one embodiment, the elongate rod 120 includes an actuating tab 126 proximate the trailing end 124 to facilitate locking and unlocking of the dispenser box 2. The second transverse side 10 has an external first surface side 164 and an internal second surface side 166. (See FIG. 15). The actuating tab 126 is configured to reside on the outside of the rectangular dispenser box 2 so that it emerges from the external first surface side 164 of the second transverse side 10. (See FIGS. 11 and 15). When the actuating tab 126 pressed, the elongate rod 120 is displaced such that the recesses 136 of the rod 120 disengage the ribs 100 of the internal surface 94 of the surface cover 82. (See, generally, FIGS. 8 and 14).

In one embodiment, the longitudinal axis Z—Z actuating tab 126 extends in a direction that is generally perpendicular (i.e., within 45 to 100 degrees) of the longitudinal axis Y—Y of the elongate rod 120. (See FIGS. 7 and 13) Generally, the actuating tab 126 extends downwardly, towards the bottom surface 12, of the box 2.

The actuating tab 126 has a first side surface 146 and a second side surface 148, these being parallel to the front and rear longitudinal sides 4,6 of the rectangular dispenser box 2. A hole 144 extends between the first side surface 146 and the second side surface 148 of the actuating tab 126. (See FIGS. 7 and 13) A tamper-proof sealing pin 168 can be inserted through the hole 144 in the actuating tab 126 to prevent movement of the actuating tab 126, thereby preventing opening of the dispenser box 2 when the insert 150 is filled with medical preparations. (See FIGS. 13 and 7)

iv. Locking/unlocking Process

To access to the medial preparations within the compartments 152, the actuating tab 126 of the elongate rod 120 is pressed inwards towards the second transverse side 10 of the box 2, in the direction of arrow 170. (See FIG. 11). When the actuating tab 126 is pressed inwards, the elongate rod 120 is displaced and disengages of the first wall 132 of the recess 136 (located on the first wall 132 of the channel 130 of the elongate rod 120) from the rib 100 (located on the internal surface 94 of the surface cover 82). Thus, the rib 100 and the recess 136 become aligned. Once the rib 100 and recess 136 are aligned, one or more selected surface covers 82 removed, generally by pressing against the wall 162, to uncover the selected compartment 152 of the insert 150. (See, generally, FIGS. 1, 10, 12).

When the actuating tab 126 is pressed, all the surface covers 82 are released. Thus, one or more (or even all) the surface covers can be removed and the elongate rod 120 can be removed from the dispenser box 2, the removal of the elongate rod 120 being carried out after releasing the pressure exerted on the actuating tab 126, in that the elongate rod 120 is pulled in the direction opposite to the pressing direction.

It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A dispenser for medical preparations comprising:

a rectangular box having a front longitudinal side, a rear longitudinal side, a first and a second transverse side, a bottom surface and a top surface;

the first transverse side comprising a removable side cover configured to close an opening between the front longitudinal side and the rear longitudinal side; the side cover slideably engaging the top and bottom surfaces; the side cover having an outer surface and an inner surface and front and rear ends; the rear end of the side cover comprising a flexible tab for securing the side cover to the rectangular box; the flexible tab comprising a flange on the outer surface for releasably engaging an inside edge of a projection extending from the rear longitudinal side of the rectangular box;

the top surface comprising a plurality of elongate apertures extending from the front longitudinal side towards the rear longitudinal side of the rectangular box;

a plurality of removable elongate surface covers configured to cover the elongate apertures; the elongate surface covers slideably engaging the top surface permitting each surface cover to be extractable in a direction transverse to the longitudinal sides of the rectangular box; the elongate surface covers each having at least a fully closed position, a fully locked position and a fully open position; the surface covers each having an external surface and an internal surface, and a first and second end, the first end of the surface cover configured to engage a locking arrangement to secure the surface cover in a closed position;

each surface cover comprising a rib proximate the first end of the surface cover; the rib having a front surface, a rear surface and first and second side surfaces; the rib projecting from the internal surface; the rib having a longitudinal axis parallel to the longitudinal sides of the box and having a length less than a length of the first end of the surface cover; the rib having an angled first side surface;

each surface cover further comprising a protrusion proximate the first end of the surface cover, the protrusion projecting from the internal surface and disposed distal to the first end of the surface cover with respect to the rib; the protrusion configured to engage an upper surface of the front longitudinal side of the rectangular box to hinder complete removal of the surface cover when in the fully open position; the locking arrangement comprising an elongate rod having a leading end and a trailing end; the rod configured to slideably engage the rectangular box and having an actuating tab at the trailing end; the elongate rod having a length between the leading end and trailing end that extends a length of the rear longitudinal side of the rectangular box; the elongate rod having an upper surface and a lower surface; the upper surface of the elongate rod comprising a channel that extends along the length of the rod wherein the channel is defined by first and second walls; the first wall comprising a plurality of recesses having a leading side surface and a trailing side surface; the recesses configured to align with the ribs projecting from the internal surfaces of the surface covers when the rod is in an unlocked position; each recess having an angled leading side surface, angled complementary to the angled side surface of the rib.

2. The dispenser of claim 1 wherein:

the surface covers are formed of clear plastic to enable contents of the rectangular box to be visualized.

3. The dispenser of claim 1 wherein:

the flexible tab comprises a serrated outer surface for providing a finger grip for pressing the flexible tab inward thereby releasing the flange for removing the side cover.

4. The dispenser of claim 1 wherein:

the elongate apertures comprise a grooved inner surface, wherein the elongate surface covers slideably engage the grooves.

5. The dispenser of claim 1 wherein:

the elongate surface cover is incrementally moveable between the fully closed position, the fully locked position, and the fully open position.

6. The dispenser of claim 1 wherein:

the elongate apertures are rectangular in shape.

7. The dispenser of claim 6 wherein:

the elongate surface covers are rectangular in shape.

8. The dispenser of claim 1 wherein:

the rib is centrally located on the first end of the surface cover.

9. The dispenser of claim 1 wherein:

the surface cover further comprises a raised rim projecting from the external surface of the surface cover, extending from a position proximate the first end of the surface cover towards the second end of the surface cover.

10. The dispenser of claim 1 further comprising:

an insert comprising a plurality of compartments, the insert being configured to store medical preparations; the insert being rectangular and sized to fit within the rectangular box.

11. The dispenser of claim 10, wherein the compartments of the insert are arranged in a plurality of rows and columns.

12. The dispenser of claim 11, wherein the compartments of the insert are arranged in seven rows.

13. The dispenser of claim 12, wherein the compartments of the insert are arranged in four columns.

14. The dispenser of claim 1, wherein the angled side surface of the rib generates a rib having a longer front surface compared to the rear surface.

15. The dispenser of claim 1, wherein the rib projecting from the internal surface of the surface cover is slidingly engaged with the leading side surface of the recess when the elongate rod is in a locked position.

* * * * *